US010443265B2

(12) United States Patent
Widén

(10) Patent No.: US 10,443,265 B2
(45) Date of Patent: Oct. 15, 2019

(54) SET OF PROFILE MEMBERS IN COMBINATION WITH A KEY PLUG, A METHOD TO MANUFACTURE SUCH A KEY PLUG AND A COMBINATION ALSO INCLUDING AN ASSOCIATED KEY

(71) Applicant: WINLOC AG, Zug (CH)

(72) Inventor: Bo Widén, Torshälla (SE)

(73) Assignee: WINLOC AG, Zug (CH)

( * ) Notice: Subject to any disclaimer, the term of this patent is extended or adjusted under 35 U.S.C. 154(b) by 0 days.

(21) Appl. No.: 15/773,751

(22) PCT Filed: Nov. 2, 2016

(86) PCT No.: PCT/EP2016/076429
§ 371 (c)(1),
(2) Date: May 4, 2018

(87) PCT Pub. No.: WO2017/076906
PCT Pub. Date: May 11, 2017

(65) Prior Publication Data

US 2018/0320408 A1 Nov. 8, 2018

(30) Foreign Application Priority Data

Nov. 6, 2015 (SE) ..... 1551438

(51) Int. Cl.
*E05B 19/00* (2006.01)
*E05B 27/00* (2006.01)
*E05B 15/08* (2006.01)

(52) U.S. Cl.
CPC ..... *E05B 19/0029* (2013.01); *E05B 15/08* (2013.01); *E05B 19/0041* (2013.01); *E05B 27/0078* (2013.01); *E05B 27/0042* (2013.01)

(58) Field of Classification Search
CPC .. E05B 15/08; E05B 19/0029; E05B 19/0041; E05B 27/0017; E05B 27/0032;
(Continued)

(56) References Cited

U.S. PATENT DOCUMENTS 4,756,177 A * 7/1988 Widen ..... E05B 27/0039 70/358
5,067,335 A * 11/1991 Widen ..... E05B 27/0082 70/358
(Continued)

FOREIGN PATENT DOCUMENTS

AT 392 506 B 4/1991
AT 005 121 U1 3/2002
(Continued)

OTHER PUBLICATIONS

International Preliminary Report on patentability for PCT/EP2016/076429 dated Jan. 22, 2018.
(Continued)

*Primary Examiner* — Christopher J Boswell
(74) *Attorney, Agent, or Firm* — Birch, Stewart, Kolasch & Birch, LLP

(57) ABSTRACT

Cylindrical locks and more specifically a set of profile members in combination with a rotatable cylindrical key plug have a longitudinal keyway with a profile corresponding to an associated key. Each profile member is accommodated in an associated cavity in the key plug at a lateral side of the keyway so as to form a lateral part thereof. The profile members have a non-circular cross-section and are non-rotatably mounted in the associated cavities at a location adjacent to the keyway. A portion of each profile member has a profiled surface portion facing inwards toward the opposite lateral side of the keyway, the profiled surface portion having, in a plane being transversal to a longitudinal axis of the key plug, a specific profile section defining a
(Continued)

local, lateral part of the keyway. An associated key, and a method to manufacture a cylindrical key plug with such profile members are also disclosed.

23 Claims, 5 Drawing Sheets

(58) Field of Classification Search
CPC ..... E05B 27/0042; E05B 27/0057; E05B 27/0078; E05B 27/02; E05B 27/08; E05B 27/083
See application file for complete search history.

(56) References Cited

U.S. PATENT DOCUMENTS 5,502,991 A * 4/1996 Sornes ..... E05B 15/08 70/453
6,427,506 B1 * 8/2002 Prunbauer ..... E05B 19/0017 70/495
7,370,502 B2 * 5/2008 Widen ..... E05B 27/0082 70/493
7,621,163 B2 * 11/2009 Widen ..... E05B 27/0082 70/493
8,156,777 B1 * 4/2012 Widen ..... E05B 27/0017 70/392
8,327,675 B2 * 12/2012 Baumann ..... E05B 27/0078 70/409
8,997,538 B2 * 4/2015 Tobias ..... E05B 47/0044 70/276
9,482,031 B2 * 11/2016 Field ..... E05B 27/0082
2004/0045402 A1 3/2004 Boily et al.

FOREIGN PATENT DOCUMENTS

DE 42 44 172 A1 6/1994
DE 10 2007 007 688 A1 8/2008
DE 20 2010 000 477 U1 8/2011
EP 0 634 541 A1 1/1995
EP 1 124 029 A1 8/2001
EP 1 466 039 A 10/2004
EP 2 466 039 A2 6/2012
WO WO 02/075023 A2 9/2002
WO WO 03/062570 A1 7/2003

OTHER PUBLICATIONS

International Search Report for PCT/EP2016/076429 dated Dec. 19, 2016.
Office Action for SE 1551438-3 dated Jun. 10, 2016.
Written Opinion of the International Preliminary Examining Authority for PCT/EP2016/076429 dated Oct. 27, 2017.
Written Opinion of the International Searching Authority for PCT/EP2016/076429 dated Dec. 19, 2016.

* cited by examiner

SET OF PROFILE MEMBERS IN COMBINATION WITH A KEY PLUG, A METHOD TO MANUFACTURE SUCH A KEY PLUG AND A COMBINATION ALSO INCLUDING AN ASSOCIATED KEY

FIELD OF THE INVENTION

The present invention relates generally to cylinder locks and more specifically to a set of profile members in combination with a rotatable cylindrical key plug having a longitudinal keyway with a profile corresponding to an associated key. The invention also relates to a method to manufacture such a key plug as well as a combination also including an associated key. The profile members are accommodated in associated cavities in the key plug at one or both lateral sides of the keyway.

BACKGROUND OF THE INVENTION AND PRIOR ART

In EP 0 634 542 A1 (TrioVing AS) there is disclosed a prior art lock cylinder where the keyway has a set of profile members defining the cross-sectional profile of the keyway. These profile members are constituted by rotation bodies inserted in cylindrical cavities being located on each lateral side of the keyway. The profile members have a varying diameter along a major portion of their length, so as to define a desired profile section in a plane transverse to the keyway. On the other hand, the cylindrical cavities, formed by bores, are uniformly wide along their length and must therefore have a diameter which can accommodate the widest portion of the rotation body.

Accordingly, the cylindrical cavities, housing the profile members, will occupy a substantial part of the volume of the key plug on the lateral sides of the keyway. Therefore, there will be a limited remaining space for accommodating bores where movable locking tumblers of the cylinder lock are to be disposed. This will cause a problem, especially but not only when the key plug is provided with central locking tumblers, cooperating with a coded edge portion of the key, as well as side locking tumblers, cooperating with a code pattern on a side surface of the key.

Another prior art cylinder lock of a similar kind is disclosed in AT 005 121 U1. Here, each of the profile member has a non-circular cross-section and is non-rotatably mounted in the associated cavity at a location adjacent to the keyway.

OBJECT OF THE INVENTION

Against this background, an object of the present invention is to provide a key plug where the set of profile members and their associated cavities will occupy a substantially smaller volume of the key plug, in the region located laterally adjacent to the keyway, so that there will be sufficient room for disposing further bores accommodating movable locking tumblers. Moreover, it should be possible to manufacture a key plug with a specific profile section in an easy and cost-effective way, offering a multitude of varying profile sections without the use of complicated tools, while maintaining a limited volume for the cavities accommodating the set of profile members. Also, it is an object of the invention to provide a structure of an associated key which will permit a selective insertion of keys into the keyway. Preferably, the structure should also make the key stronger, especially to withstand substantial torsional forces.

SUMMARY OF THE INVENTION

These and other objects are achieved by providing a special structure, where each cavity is formed by a first part, located at a lateral distance from the keyway, and a second part, which communicates with said first part and is extended laterally sideways so as to communicate with the keyway, said first and second parts communicating via a narrowed part, which is narrower than said first and second part, and said profile members having first and second portions corresponding to said first and second parts of the associated cavity, a neck portion corresponding to said narrowed part and a cross-sectional contour being circumscribed by the cross-section of said first and second parts of the associated cavity, so as to be fitted in a non-rotatable well-defined position therein, and said second portion of each profile member is provided with said profiled surface portion facing inwards toward the opposite lateral side of the keyway, whereas said first portion and said neck portion of each profile member occupy substantially the whole cross-section of said first part and said narrowed part of the associated cavity.

In this way, the first part of each cavity housing a profile member will be situated at some distance from the keyway, and the diameter or widest portion of this part can occupy a relatively small volume. Consequently, the total volume of the cavities will be relatively small, and there will be sufficient space to accommodate further holes for housing a desired number of locking tumblers.

The invention also provides a method of manufacturing a cylindrical key plug having a profiled longitudinal keyway adapted to cooperate with an associated key, wherein

- the key plug is machined to form a longitudinal slot with a uniform cross-sectional profile,
- a number of cavities are made in the key plug on at least one lateral side of the longitudinal slot, each cavity being formed by a first part, located at a lateral distance from the keyway, and a second part, which communicates with said first part and is extended laterally sideways so as to communicate with the keyway, said first and second parts communicating via a narrowed part,
- a set of profile members are inserted into said cavities,
- each profile member having a non-circular cross-section, including a first portion corresponding to said first part of the cavity, a second portion corresponding to said second part of the cavity, and a neck portion corresponding to said narrowed part of the cavity, said non-circular cross-section of each profile member being circumscribed by the cross-section of an associated cavity, and
- each of said profile members being non-rotatably mounted in a respective cavity at a location adjacent to said key slot so as to form a lateral part thereof, with a profiled surface portion on said second portion of the profile member facing inwards toward the opposite lateral side of the key slot, said profiled surface portion having, in a plane being transversal to a longitudinal axis of said key plug, a specific profile section defining a local, lateral part of said profiled longitudinal keyway.

Preferably, the cavities are formed by making two adjacent and partially overlapping parallel bores, which constitute said first and second parts of the cavity.

The profile members, or at least one or two of them, may be made of hard material which is substantially harder than the material of the cylindrical key plug. It is per se previously known to provide side members or "locking bolts" of a hard material so as to provide anti-drilling protection, e.g. as disclosed in FIGS. 15-31 and the associated part of the description of EP 1 466 039 A" (Talleres De Escoriaza S.A.). In this prior art embodiment, however, the oppositely disposed "locking bolts" are located entirely in associated cavities at some distance from the wall material defining the keyway, and these locking bolts do not form a part of the wall surface defining the keyway. So, the profile section of the keyway is produced in an ordinary way, with special tools that can cut out the particular profile section of the keyway.

According to another aspect of the invention, the profile member/key plug combination also includes an associated profiled key having a profile section corresponding to the specific profile section of the keyway of the key plug.

BRIEF DESCRIPTION OF THE DRAWINGS

The invention will now be explained further with reference to the appended drawings illustrating a preferred embodiment of the invention.

DETAILED DESCRIPTION OF SOME PREFERRED EMBODIMENTS OF THE INVENTION

Figure 1A:
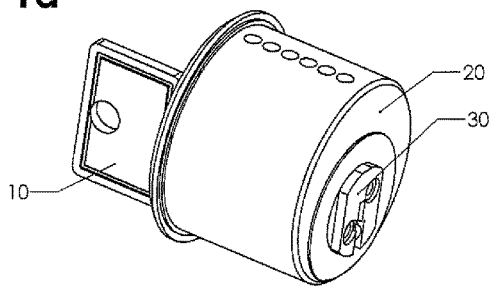
FIG. 1*a* shows schematically, in a perspective view, a cylindrical lock with a key plug and a key.

In FIG. 1*a* there is shown a key 10 and cylinder lock having a stationary housing 20 and a rotatable cylindrical key plug 30. As is well-known in the art of cylinder locks, the key plug 30 can be rotated, normally by means of the key 10, when a number of locking tumblers (not shown) in the key plug are positioned so as to leave a shear line free between an outer surface of the key plug 30 and an inner surface of the housing 20. In FIG. 1*c* one can see a number of bores for accommodating such locking tumblers or pins, in this case a row of central bores 31 accommodating central pins (not shown) and another row of bores 32 for side locking tumblers (not shown either).

Figure 1B:
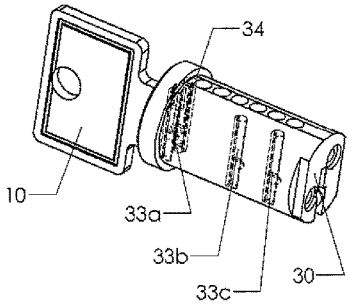
FIG. 1*b* shows, also in a perspective view, the key plug and the key of FIG. 1*a*, with the housing of the lock taken away for clarity.
Figure 1C:
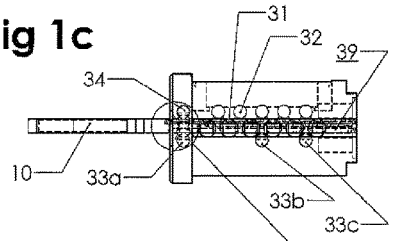
FIG. 1*c* shows, in a view from above, the key plug shown in FIG. 1*b*, also showing a number of further bores which accommodate a number of movable locking tumblers.

In addition to the bores 31, 32, there are a number of bores 33*a*, 33*b*, 33*c*, 34, being parallel to the bores 31,32 and being shown better in FIG. 1*b* with dashed lines. These bores 33*a*, 33*b*, 33*c*, 34 or cavities serve to accommodate a set of profile members 43*a*, 43*b*, 43*c*, 44 which are non-rotatably mounted in the respective cavities 33*a*, 33*b*, 33*c*, 34, respectively. See FIG. 2*a*.

Actually, each cavity 33*a*, 33*b*, 33*c*, 34 is constituted, in the preferred embodiment shown on the drawings, by two adjacent and partially overlapping parallel cylindrical bores, having a contour like the digit "8". This will be seen in FIG. 1*d*, illustrating two opposite cavities each housing a profile member (not shown).

Figure 1E:
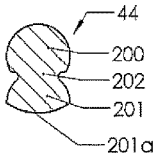
FIG. 1*e* shows a cross-section of a profile pin, which fits into the bores indicated in FIG. 1*c*1.
Figure 1D:
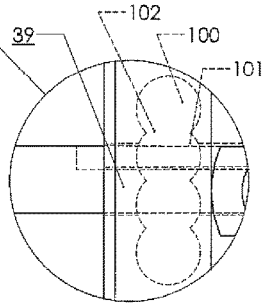
FIG. 1*d* shows a detail from FIG. 1*c*, in a larger scale.

According to the present invention, each of the profile members 43*a*, 43*b*, 43*c*, 44 has a non-circular cross-section and is non-rotatably mounted in an associated cavity 33*a*, 33*b*, 33*c*, 34 at a location adjacent to the keyway 39 (see FIGS. 1*c*, 1*d*, 1*e*). The arrangement is such that the cross-sectional size of these cavities is relatively small and makes it possible to leave enough room in the key plug for accommodating the further rows of bores 31 and 32.

As will be seen from FIG. 1*d*, each cavity is formed by a first part 100, located at a lateral distance from the keyway 39. In this embodiment this part 100 is a cylindrical bore with a circular cross-section. The first part 100 is extended sideways into a second part 101, which communicates with the first part 100. The second part 101 also communicates directly with the keyway 39. In this embodiment, the second part 101 is also formed by a cylindrical bore, which partially overlaps with the bore forming the first part 100.

The first and second parts 100,101 communicate with each other via a narrowed part 102.

The associated profile member 44 is configured to fit, with a slight play, into the cavity 100,101 and has a first portion 200 corresponding to the first part 100 of the cavity, a second portion 201 corresponding to the second part 101 of the cavity, and a neck portion 202 corresponding to the narrowed part 101 of the cavity. The cross-sectional contour of the profile member is circumscribed by the cross-section of the first and second parts 100,101 of the cavity. Also, at least the first portion 200 and the neck portion 202 of the profile member occupies substantially the whole cross-section of the first part 100 and the narrowed part 102 of the cavity. In this way, the profile member will be fitted non-rotatably in a well-defined position in the cavity 100,101. Thus, the profile member cannot rotate or turn, but it may be movable elevationally in the cavity, if so desired. It should be pointed out that the first and second parts of the cavity, and the first and second portions of the profile member, do not have to be part-circular in cross-section but may have a different geometrical configuration, e.g. more elongated or rectangular. Also, the overall shape should be such as to prevent that the profile member falls out from the cavity into the keyway.

In accordance with the invention, a main function of the profile members 43*a*, 43*b*, 43*c*, 44 is to provide a profile section of the keyway, by forming a part of the lateral side of the keyway. For this purpose, the second portion 201 of the profile member is provided with a profiled surface portion 201*a* (see FIG. 1*e*) facing inwards toward the opposite lateral side of the keyway. This surface portion can be varied so as to provide a specific profile section defining a local, lateral part of the keyway. See the various profile members shown in FIGS. 8*a*, 9*a*, . . . , 17*a*.

In a preferred embodiment, as illustrated on the drawings, the surface portion 201*a* is convex and arcuate in cross-section, so that, in a plane which is transverse to a longitudinal direction of the keyway, the surface portion 201*a* has a specific profile which will be complementary to the profiled key 10 and will guide the latter when it is inserted longitudinally into the keyway. There are preferably such profile guiding surface portions on both lateral sides of the keyway, so that the key is guided precisely between these lateral profiled surfaces. It will be understood that the keyway is not uniform all the way in the longitudinal direction but has a number of profiled lateral sections that will ensure a proper guiding and screening. Only keys having a profile that corresponds to the various profiled lateral sections of the profile members will fit into the keyway. This is illustrated also by FIG. 3 which shows how the key 10 fits precisely between the profile members 43*c* and 44. The other profile members 43*a* and 43*b* are hidden behind the profile member 43*c*, except for a small lug projecting into the keyway.

Figure 2A:
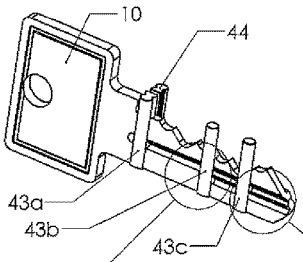
FIG. 2*a* shows, likewise in a perspective view, the key of FIG. 1*a*,1*b*, 1*c* and some profile members in the key plug, the rest of the key plug and the housing being taken away for clarity.
Figure 2B:
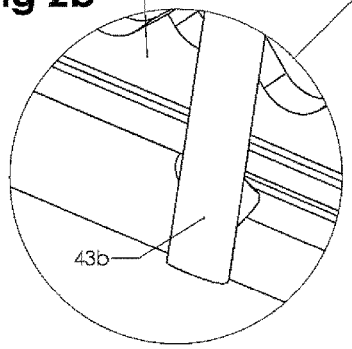
FIG. 2*b* shows a detail of FIG. 2, in a larger scale.
Figure 2C:
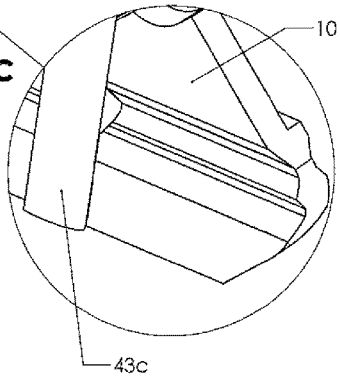
FIG. 2*c* shows another detail of FIG. 2, also in a larger scale.
Figure 4A:
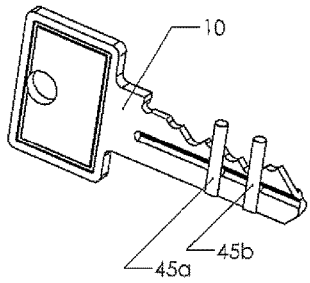
FIG. 4*a*, 4*b*, 4*c* show, in perspective views, three alternative embodiments of the arrangement of the set of profile elements at the lateral side or sides of the keyway.
Figure 4B:
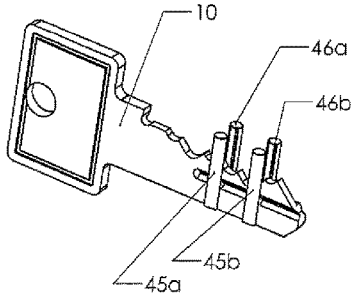
Figure 4C:
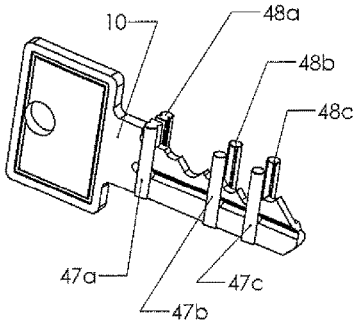

The profile members may be arranged in a many different ways along the keyway, as exemplified by FIG. 2*a*, where there are three profile members 43*a*, 43*b*, 43*c* on one side of the keyway and one profile member 44 on the other side, FIG. 4*a*, where there are only two profile members 45*a*, 45*b* on one side of the keyway, FIG. 4*b*, where there are two profile members 45*a*, 45*b* and 46*a*, 46*b* on each side of the keyway and the pairs being displaced longitudinal relative to each other, and FIG. 4*c*, where there are three profile members 47*a*, 47*b*, 47*c* and 48*a*, 48*b*, 48*c*, respectively, on each lateral side of the keyway and the profile members being located opposite to each other pairwise (47*a*, 48*a* and 47*b*, 48*b* and 47*c*,48*c*). It will be understood that there is a great flexibility in respect of the particular arrangement of the set of profile elements. It will be possible to locate the profile members in positions that are suitable in view of the locations of other bores in the key plug (compare FIG. 1*c*).

In the particular embodiment of the key shown in FIG. 4*b*, the groove in the side surface of the key is relatively short. In general, the grooves in the side surface of the key may have different lengths so as be no longer than to match the position of the profile member having a lug or other profile part that projects into the groove when the key is fully inserted into the keyway.

By providing side grooves of different lengths, it will also be possible to make a lock and key system to become selective. Thus, a key as shown in FIG. 4*b* will fit into a key plug with profile elements as shown in FIG. 4*a*, but not in a key plug with profile members as shown in FIG. 4*c*, whereas the key of FIG. 4*c* will fit into the key plug with profile members as shown in FIGS. 4*a* and 4*b*.

An embodiment, where the groove or grooves are relatively short, will have the advantage of making the key stronger in the portion closest to the grip. In this way, the key will withstand strong torques when the key is turned in order to rotate the key plug. Of course, if the key has a solid material in its cross-section, the torque resistance will be stronger.

Figure 5:
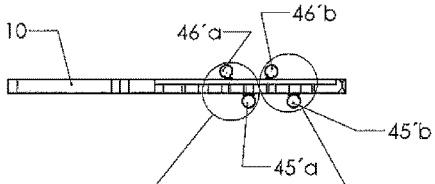
FIG. 5 shows, in a view from above, a key and a set of profile elements, similar to FIG. 4*b* (the rest of the key plug taken away for clarity), where the profile elements are turned or rotated so that a profiled surface portion faces obliquely toward the opposite side of the keyway.
Figure 5A:
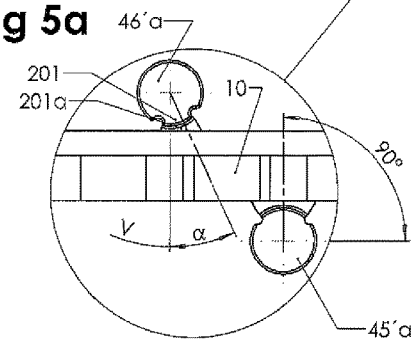
FIG. 5*a* shows a part of FIG. 5, in a larger scale.
Figure 5B:
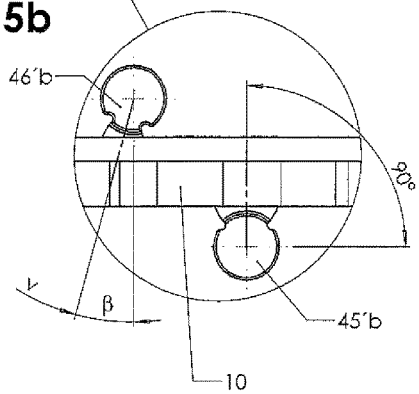
FIG. 5*b* shows another part of FIG. 5, in a larger scale.

Normally, the surface portion 201*a* on the profile members faces the opposite side of the keyway at right angle. However, as shown in FIGS. 5,5*a* and 5*b*, it may be advantageous to let the cavity and the profile surface of the profile member face or point in a direction which is oblique to a transversal plane to the keyway. In FIG. 5*a*, the second portion 201 of the profile member 46'*a* is pointing at an angle α towards the tip end of the key, whereas the oppositely located profile member 45'*a* stands at right angle to the keyway and the key. In FIG. 5*b*, on the other hand, the second portion 201 of the profile member 46'*b* stands at an angle β in a direction towards the grip end of the key. Here, the opposite profile member 45'*b* stands at right angle to the key 10.

It may be favorable to have a pair of profile members, such as the profile members 47*a* and 48*a*, in the vicinity of an entrance opening of the keyway (to the left in FIG. 1*a* and FIG. 1*b*), with the second portions 201 of these profile members both pointing at an angle towards the grip end of the key 10. Then, one can make effective use of the available space in the keyway. Compare FIG. 1*c* and FIG. 2*a*, also showing a pair of profile members 43*a*, 44 in the vicinity of the entrance opening of the keyway. With such an arrangement, there will be much room for other bores 31, 32 (FIG. 1*c*) in the key plug.

In embodiments having profile members arranged adjacent to the entrance opening of the keyway, such as in FIG. 2*a* and FIG. 4*c*, it may be favorable to make the profile members of a very hard material to provide drill protection and prevent the lock to be destroyed (or making it more difficult to destroy the lock). Thus, the profile members, even those located at other positions along the key plug, may be made of hardened steel, e.g. case hardened steel, or tungsten carbide. The rest of the key plug is normally made of brass.

Figure 6:
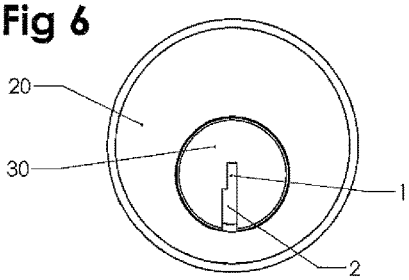
FIG. 6 shows an end view of the cylinder lock of FIG. 1*a*, where the key and the profile elements have been taken away.
Figure 7A:
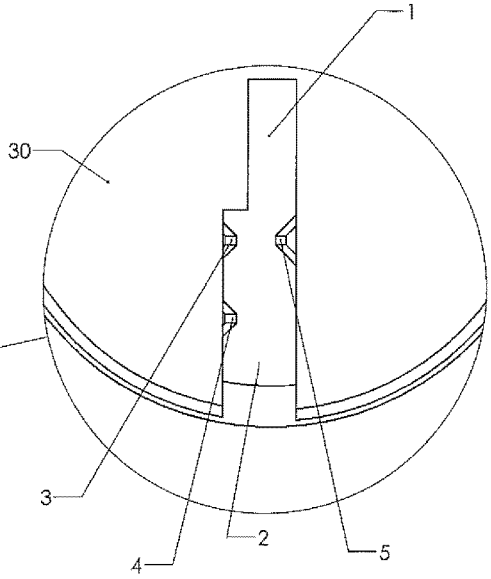
FIGS. 7 and 7*a* show, in an end view corresponding to FIG. 6, the key plug including profile members inserted in their associated cavities.
Figure 7:
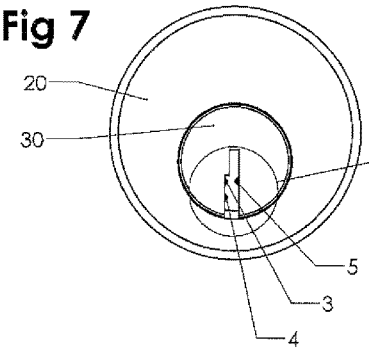

The concept of providing a complex profile configuration of the keyway by means of the w profile elements is well illustrated in FIGS. 6, 7 and 7*a*. First, a relatively simple geometrical configuration of a key slot is machined in the key plug, as shown in FIG. 6 (without any profile members). This configuration may e.g. consist of two rectangular (in cross-section perpendicularly to a longitudinal axis of the keyway) parts, viz. an upper rather narrow rectangular part 1 and a lower, somewhat wider rectangular part 2. Such parts are relatively easy to manufacture, e.g. by means of a cutter disc, or even a cutter pin being guided longitudinally along the key plug.

Then, the desired profile of the keyway is obtained by inserting profile members as described above. FIG. 7 shows the resulting keyway having, in addition to the basic rectangular configuration, a number of irregularities formed by lugs 3, 4, 5. Of course, by varying the surface portions 201*a* on the profile members, it is possible to achieve a desired profile section, even with a complex or special configuration. In this way, it will be possible to provide a multitude of profile variations by simply exchanging the particular profile members.

The profile members may be configured or tailor-made in many different ways. As mentioned above, the first and second portions 200 and 201 (FIG. 1*e*) may be non-circular in cross-section, although it is very convenient and cost-effective to make these portions part-cylindrical, with a part-cylindrical cross-section. The associated cavities are also relatively easy to manufacture, e.g. by drilling bores that partially overlap each other, as illustrated in FIG. 1*d*.

Figure 8A:
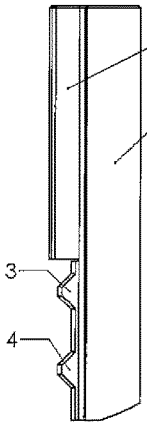
FIGS. 8*a*,8*b*,8*c*, 9*a*,9*b*,9*c*, 10*a*,10*b*, 10*c*, 11*a*,11*b*, 11*c*, 12*a*,12*b*,12*c*, and 13*a*,13*b*,13*c* show, in a side view, a front view and a top view, respectively, six different embodiments of profile members of the present invention.
Figure 8B:
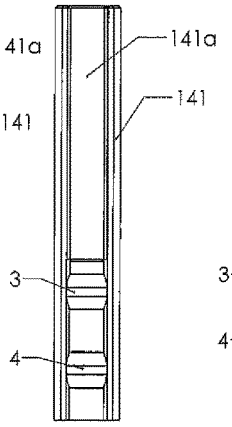
Figure 8C:
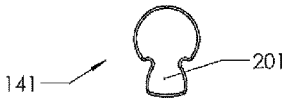

In FIGS. 8*a*, 8*b*, 8*c*; 9*a*, 9*b*, 9*c*; etc. a number of possible embodiments of the profile members are illustrated.

Figure 3:
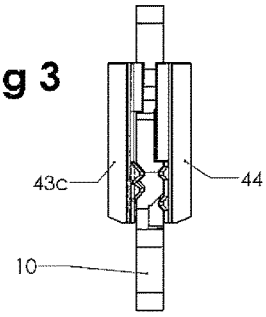
FIG. 3 shows an end view of the key and the profile members shown in FIG. 1*a;*

In FIGS. 8*a*, 8*b*, 8*c*, the profile member 141 is provided with an upper straight portion 141*a* which protrudes sideways into the keyway, compare FIG. 3, and two lower lugs 3,4 which will form a part of the lateral profile of the keyway. Such lugs are also visible in FIG. 3. The second portion 201 of the profile member 141, see FIG. 8*c*, is widened and has a slightly convex surface portion defining the profile.

Figure 9A:
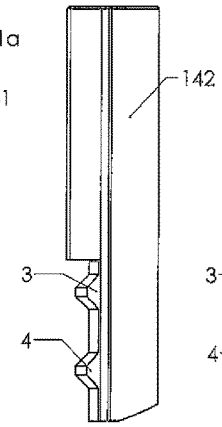
Figure 9B:
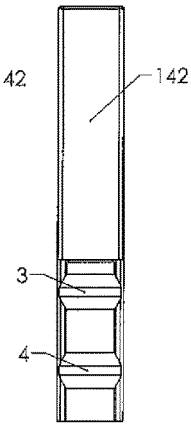
Figure 9C:
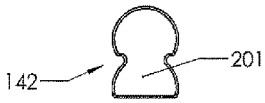

In FIGS. 9*a*, 9*b*, 9*c*, the profile member 142 is quite similar, with an upper straight portion and two lower lugs, but has an even wider second portion 201. In this case, the surface portion defining the profile is flat.

Figure 10A:
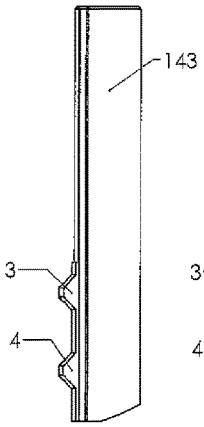
Figure 10B:
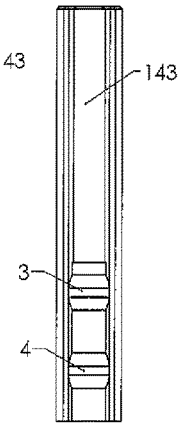
Figure 10C:
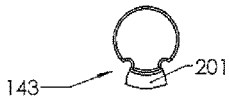

The embodiment of the profile element 143 shown in FIGS. 10*a*, 10*b*, 10*c* has a straight surface portion 201 extending all along the profile member, and two lower lugs 3, 4 projecting into the keyway. These lugs 3,4 are shaped very much like the lugs 3,4 in FIGS. 8*a*, 8*b*, 8*c*, with a slightly convex surface portion defining the profile of the lugs.

Figure 11A:
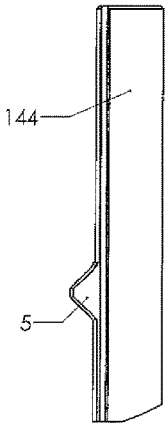
Figure 11B:
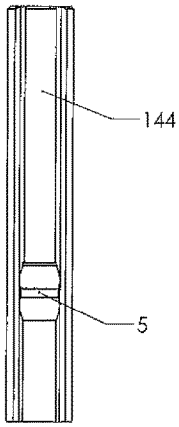
Figure 11C:
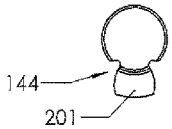

The profile member 144 shown in FIGS. 11*a*, 11*b* and 11*c* is similar to the embodiment of FIGS. 10*a*, 10*b*, 10*c*, but has only one FIG. 5, which projects a little longer into the keyway. The surface portion defining the profile is slightly convex.

Figure 12A:
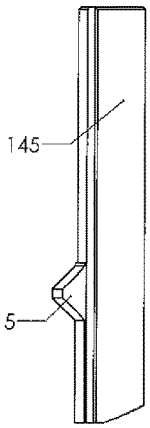
Figure 12B:
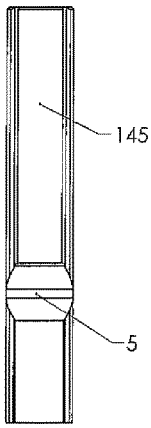
Figure 12C:
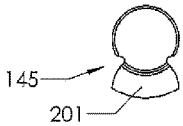

In FIGS. 12*a*, 12*b*, 12*c*, the single lug 5 of the profile element 145 is much wider than in the preceding embodiment and also has a convex surface defining the profile.

Figure 13A:
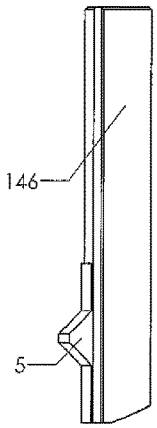
Figure 13B:
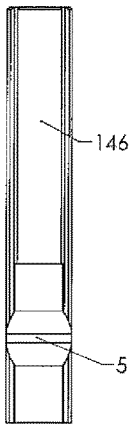
Figure 13C:
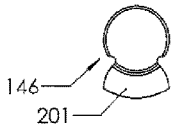

The embodiment shown in FIGS. 13*a*, 13*b*, 13*c* is quite similar to that shown in FIGS. 12*a*, 12*b*,12*c* but its single lug 5 is located lower, not far from the lower end of the profile element 146.

Figure 14A:
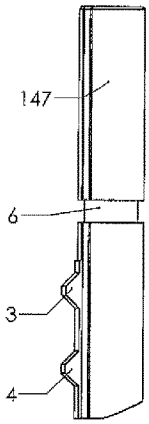
FIGS. 14*a*, 14*b*, 14*c* and 15*a*, 15*b*, 15*c* show, in similar views, two further embodiments of profile members also having a recess portion, in addition to one or two lugs.
Figure 14B:
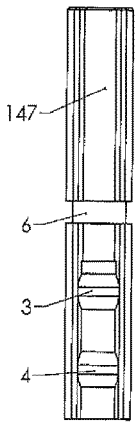
Figure 14C:
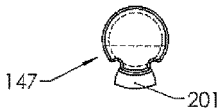

In FIG. 14*a*, 14*b*,14*c*, the profile element 148 has two lugs 3,4 and also an upper annular recess 6 which will accommodate a longitudinal rib portion (not shown) on an associated key (not shown either).

Figure 15A:
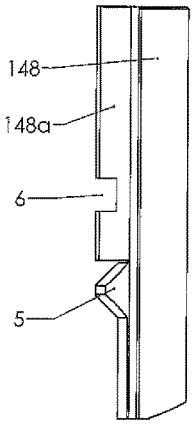
Figure 15B:
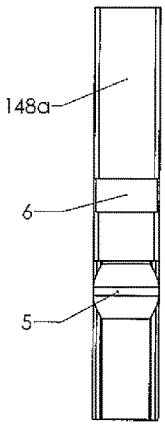
Figure 15C:
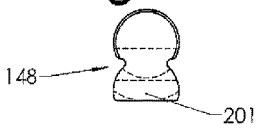

The embodiment shown in FIGS. 15*a*, 15*b*, 15*c* is similar, with an upper recess 6, but the profile element 148 has only one lug 5. The second portion 201 (FIG. 15*c*) is rather wide, and the surface portion defining the profile is flat.

Figure 16A:
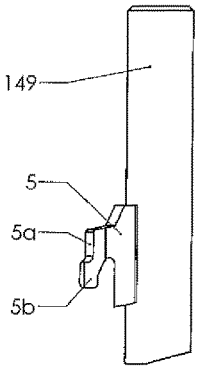
FIGS. 16*a*, 16*b*, 16*c* show, in similar views, a profile member having a lug with a tongue having an end portion pointing downwardly.
Figure 16B:
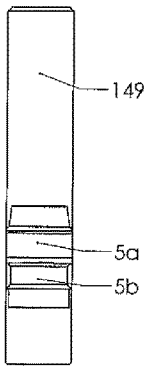
Figure 16C:
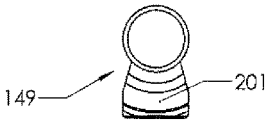

In FIGS. 16*a*, 16*b*, 16*c*, there is shown a profile element 149 having a single lug 5 with a tongue portion 5*a* and a downwardly pointing end portion 5*b*. Such a lug 5, with a downwardly (and/or upwardly) pointing end portion can be accommodated in an undercut groove in a side surface of an associated key (not shown). Such a groove may have one or two (upper and lower) undercut portions.

Figure 17A:
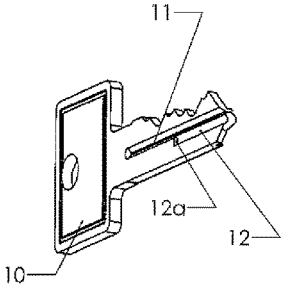
FIG. 17*a* shows, in a perspective view, a key with two side grooves.
Figure 17B:
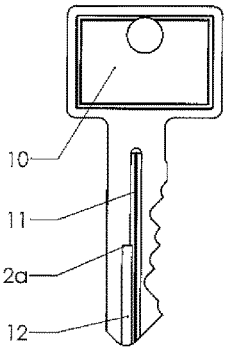
FIG. 17*b* shows a side view of the key in FIG. 17*a*.

In FIGS. 17*a* and 17*b*, there is shown a key 10 similar to the one shown in FIG. 2*a*. However, in this embodiment, there is no stop shoulder near the gripping portion, as is a conventional structure of a cylinder lock key. Instead, one of the longitudinal grooves 11, 12 in a side surface of the key is shorter (the groove 12) and has at its end a stop surface 12*a*, which will replace the conventional stop shoulder near the grip of the key.

The profile elements, the key plug and the associated key according to the invention may be modified in relation to the preferred embodiments described above. As indicated above, the cross-section of the two portions 200, 201 (FIG. 1*e*) of the profile element may be non-circular, and the neck portion may be almost negligible, so that the overall cross-sectional shape is almost oval or elliptic. However, the configuration must be such that the profile member does not fall out of the associated cavity.

The exact cross-sectional shape of the profile element does not have to correspond exactly to the surrounding cavity. However, in order to utilize the available space in the key plug, the material of the profile element should substantially fill out the volume of the first part 100 of the associated cavity (see FIGS. 1*d* and 1*e*).

Of course, the key plug may have only one kind of locking tumblers or pins, e.g. only pins cooperating with an edge portion of the key (and no side tumblers), or other kind of tumblers, such as side tumblers being movable at right angle to a side surface of the key.

The profile configuration of the keyway, and of the associated key, may be varied widely, with more grooves on the side surfaces of the key, or a number of stepwise transitions of the profile. With the profile being determined by the exchangeable profile members, it is relatively ease to obtain a desired profile section, even with a rather complicated geometry.

The key should be substantially flat, possibly with differently thick upper, middle and lower portions.

The invention claimed is:

1. A cylinder lock comprising:

a stationary housing and a rotatable cylindrical key plug being rotatably mounted in said stationary housing, said rotatable key plug having a row of locking tumblers being arranged along a longitudinal keyway in the key plug, said keyway having a width and a height, wherein:

a set of profile members, in addition to said row of locking tumblers, are provided in said rotatable cylindrical key plug adjacent to said longitudinal keyway with a profile corresponding to an associated key, each of said profile members in said set being accommodated in a stationary position in an associated cavity in the key plug at a lateral side of said keyway so as to form a lateral part thereof, with a profiled surface portion having, in a plane being transversal to a longitudinal axis of said key plug, a specific profile section defining a local, lateral part of said keyway, wherein each of said profile members has a non-circular cross-section and is non-rotatably mounted in said associated cavity at a location adjacent to said keyway, and wherein:

each cavity is formed by a first part, located at a lateral distance from the keyway, and a second part, which communicates with said first part and is extended laterally sideways so as to communicate with the keyway, said first and second parts communicating via a narrowed part, which is narrower than said first part, said profile members having first and second portions corresponding to said first and second parts of the associated cavity, a portion corresponding to said narrowed part and a cross-sectional contour being circumscribed by the cross-section of said first and second parts of the associated cavity, so as to be fitted in a non-rotatable well-defined stationary position therein, said first portion and said second portion of each profile member occupy substantially the whole cross-section of said first part and said narrowed part of the associated cavity, said second portion of each profile member is provided with said profiled surface portion facing inwards toward the opposite lateral side of the keyway, and said profiled surface portion extends along at least a major part of half of said height of the keyway, so as to define a substantial lateral part thereof.

2. The cylinder lock, as defined in claim 1, wherein said set of profile members comprises at least two profile members located on the same lateral side of said keyway of the key plug.

3. The cylinder lock, as defined in claim 1, wherein said set of profile members comprises at least one profile member being located on each lateral side of said keyway of the key plug.

4. The cylinder lock, as defined in claim 3, wherein said set of profile members comprises at least one pair of profile members being located opposite to each other on a respective lateral side of said keyway of the key plug.

5. The cylinder lock, as defined in claim 3, wherein at least two profile members are located on each lateral side of said keyway of the key plug.

6. The cylinder lock, as defined in claim 5, wherein said at least two profile members on a respective lateral side of the keyway are displaced longitudinally in relation to the at least two profile members located on the other side of said keyway.

7. The cylinder lock, as defined in claim 1, wherein said set of profile members comprises at least one profile member with said profiled surface portion facing obliquely towards the opposite side of the keyway.

8. The cylinder lock, as defined in claim 7, wherein there are at least two opposite profile members having obliquely facing profiled surface portions.

9. The cylinder lock, as defined in claim 1, wherein said specific profile section of said profile member comprises at least one profiled lug projecting into said key way, each lug being configured to accommodate a corresponding longitudinal profile groove in an associated key.

10. The cylinder lock, as defined in claim 9, wherein said at least one profiled lug is formed as a tongue with an end portion pointing in a different direction, said different direction being at least one of vertically upwards and vertically downwards in said keyway, so as to accommodate an undercut groove in said associated key, said undercut groove having at least one undercut portion.

11. The cylinder lock, as defined in claim 1, said combination also including an associated profiled key having a profile section corresponding to said specific profile section of said keyway.

12. The cylinder lock and an associated profiled key, as defined in claim 11, wherein said set of profile members comprise at least two profile members having profiled lugs located at different levels, as seen in a central plane of said keyway, and wherein said associated profiled key has corresponding profile grooves located at two or more vertical levels, as seen in a central plane of said key.

13. The cylinder lock and an associated profiled key, as defined in claim 12, wherein said associated profiled key has at least two longitudinal grooves of different lengths in a longitudinal direction of said key.

14. The cylinder lock and an associated profiled key, as defined in claim 13, wherein one of said longitudinal grooves has an end portion configured to form an abutment for a profile member and to serve as a stop for the key when it is fully inserted into said keyway.

15. The cylinder lock, as defined in claim 1, wherein said specific profile section of said profile member comprises at least one profiled recess configured to accommodate a corresponding longitudinal rib portion on said associated key.

16. The cylinder lock, as defined in claim 1, wherein at least one of said cavities is formed of two adjacent and partially over-lapping bores, which constitute said first and second parts of the cavity.

17. The cylinder lock, as defined in claim 16, wherein said two adjacent and partially overlapping cylindrical bores are oriented in parallel to further bores in said cylindrical key plug, said further bores accommodating movable locking tumblers.

18. The cylinder lock, as defined in claim 16, wherein said two adjacent and partially overlapping cylindrical bores have a contour like the digit "8".

19. The cylinder lock, as defined in claim 1, wherein at least one of said profile members is made of a hard material which is substantially harder than the material of said cylindrical key plug.

20. The cylinder lock, as defined in claim 19, wherein two of said profile members being made of said hard material are located adjacent to an entrance end of said keyway of the key plug.

21. A method of manufacturing a cylinder lock with a cylindrical key plug having a profiled longitudinal keyway adapted to cooperate with an associated key, said keyway having a width and height wherein the key plug is machined to form a longitudinal slot with a uniform cross-sectional profile, a number of cavities are made in the key plug on at least one lateral side of the longitudinal slot, each cavity being formed by a first part, located at a lateral distance from the keyway, and a second part, which communicates with said first part and is extended laterally sideways so as to communicate with the keyway, said first and second parts communicating via a narrowed part, which is narrower that said first and second parts, a set of profile members are inserted into said cavities, each profile member having a non-circular cross-section, including a first portion corresponding to said first part of the cavity, a second portion corresponding to said second part of the cavity, and a neck portion corresponding to said narrowed part of the cavity, said non-circular cross-section of each profile member being circumscribed by the cross-section of an associated cavity, and each of said profile members being non-rotatably fitted in a respective cavity at a stationary location adjacent to said keyway so as to form a lateral part thereof, with a profiled surface portion on said second portion of the profile member facing inwards toward the opposite lateral side of the keyway, said profiled surface portion having, in a plane being transversal to a longitudinal axis of said key plug, a specific profile section defining a local, lateral part of said profiled longitudinal keyway, wherein said first portion and said neck portion of each profile member occupy substantially the whole cross-section of said first part and said narrowed part of the associated cavity, said second portion of each profile member being provided with said profiled surface portion facing inwards toward the opposite lateral side of the keyway, and said profiled surface portion extends along at least a major part of said height of the keyway, so as to define substantially the whole lateral part thereof.

22. The method as defined in claim 21, wherein each of said cavities are formed by making two adjacent and partially overlapping parallel bores, one of said parallel bores partially overlapping and communicating with said longitudinal keyway of the key plug.

23. The method as defined in claim 22, wherein said partially overlapping bores are oriented in parallel with a number of further bores in which associated movable locking tumblers are inserted.

* * * * *